US009534268B2

(12) United States Patent
Ratte

(10) Patent No.: US 9,534,268 B2
(45) Date of Patent: Jan. 3, 2017

(54) METHOD FOR MANUFACTURING A HOT PRESS-HARDENED COMPONENT AND USE OF A STEEL PRODUCT FOR MANUFACTURING A HOT PRESS-HARDENED COMPONENT

(75) Inventor: Evelin Ratte, Mettmann (DE)

(73) Assignee: Outokumpu Nirosta GmbH, Krefeld (DE)

( * ) Notice: Subject to any disclaimer, the term of this patent is extended or adjusted under 35 U.S.C. 154(b) by 223 days.

(21) Appl. No.: 13/375,643

(22) PCT Filed: Jun. 17, 2010

(86) PCT No.: PCT/EP2010/058527
§ 371 (c)(1),
(2), (4) Date: Jul. 9, 2012

(87) PCT Pub. No.: WO2010/149561
PCT Pub. Date: Dec. 29, 2010

(65) Prior Publication Data

US 2012/0273092 A1 Nov. 1, 2012

(30) Foreign Application Priority Data

Jun. 24, 2009 (DE) ..... 10 2009 030 489

(51) Int. Cl.
*C21D 1/19* (2006.01)
*C22C 38/18* (2006.01)
(Continued)

(52) U.S. Cl.
CPC ..... *C21D 1/673* (2013.01); *C21D 1/06* (2013.01); *C21D 1/18* (2013.01); *C21D 6/002* (2013.01); *C22C 38/20* (2013.01)

(58) Field of Classification Search
CPC ... C22C 38/18; C22C 38/40; C21D 2211/008; C21D 1/02
(Continued)

(56) References Cited

U.S. PATENT DOCUMENTS 3,389,991 A * 6/1968 Tanczyn ..... C22C 38/38 148/326
3,595,643 A 7/1971 Boyce et al.
(Continued)

FOREIGN PATENT DOCUMENTS

DE 1533381 B1 7/1970
DE 69423930 T2 8/2000
(Continued)

OTHER PUBLICATIONS

Table 1.1 entitled "Essential and incidental elements in steel and cast iron", Introduction to Steels and Cast Irons, ASM 1972.*
(Continued)

*Primary Examiner* — Deborah Yee
(74) *Attorney, Agent, or Firm* — The Webb Law Firm

(57) ABSTRACT

A method of manufacturing a hot press-hardened component comprises the following production steps: a) providing a steel product produced at least in sections from a stainless steel comprising of the following composition (specified in % wt.) C: 0.010-1.200%, P: up to 0.1%, S: up to 0.1%, Si: 0.10-1.5%, Cr: 10.5-20.0% and optionally one or more elements from the group "Mn, Mo, Ni, Cu, N, Ti, Nb, B, V, Al, Ca, As, Sn, Sb, Pb, Bi, H" with the requirement Mn: 0.10-3.0%, Mo: 0.05-2.50%, Ni: 0.05-8.50%, Cu: 0.050-3.00%, N: 0.01-0.2%, Ti: up to 0.02%, Nb: up to 0.1%, B: up to 0.1%, V: up to 0.2%, Al: 0.001-1.50%, Ca: 0.0005-0.003%, As: 0.003-0.015%, Sn: 0.003-0.01%, Sb: 0.002-0.01%, Pb: up to 0.01%, Bi: up to 0.01%, H: up to 0.0025%, remainder iron and unavoidable impurities; b) heating the
(Continued)

steel product to an austenization temperature abovethe Ac3 temperature of the stainless steel; c) hot press-hardening the heated steel product in a pressing die to form the component; and d) cooling at least one section of the component at a cooling rate that is high enough for a martensitic structure to form in each section that is rapidly cooled.

12 Claims, 1 Drawing Sheet

(51) Int. Cl.

| | |
|---|---|
| ***C21D 8/00*** | (2006.01) |
| ***B21D 22/02*** | (2006.01) |
| ***C21D 1/673*** | (2006.01) |
| ***C21D 1/06*** | (2006.01) |
| ***C21D 1/18*** | (2006.01) |
| ***C21D 6/00*** | (2006.01) |
| ***C22C 38/20*** | (2006.01) |

(58) Field of Classification Search
USPC ..... 148/325, 327, 608, 647, 649, 654
See application file for complete search history.

(56) References Cited

U.S. PATENT DOCUMENTS

| | | | | | |
|---|---|---|---|---|---|
| 3,702,126 | A | * | 11/1972 | Eklund et al. | 188/251 M |
| 4,112,732 | A | * | 9/1978 | Okunishi et al. | 72/334 |
| 4,126,492 | A | | 11/1978 | Okunishi et al. | |
| 5,427,635 | A | | 6/1995 | Bletton et al. | |
| 5,624,504 | A | * | 4/1997 | Miyakusu et al. | 148/325 |
| 5,979,614 | A | * | 11/1999 | Takahashi et al. | 188/218 XL |
| 6,764,555 | B2 | * | 7/2004 | Hiramatsu | C21D 6/004 148/325 |
| 7,556,865 | B2 | | 7/2009 | Drillet et al. | |
| 7,892,654 | B2 | | 2/2011 | Hofmann et al. | |
| 7,976,650 | B2 | | 7/2011 | Drillet et al. | |
| 2007/0006461 | A1 | * | 1/2007 | McCrink | C21D 6/002 29/894.3 |
| 2009/0242086 | A1 | * | 10/2009 | Thomas | C21D 1/673 148/654 |
| 2010/0065160 | A1 | | 3/2010 | Meurer et al. | |
| 2010/0089504 | A1 | * | 4/2010 | Kawabata | C21D 6/004 148/605 |

FOREIGN PATENT DOCUMENTS

| | | | |
|---|---|---|---|
| DE | 102005008410 | B3 | 2/2006 |
| DE | 102006039307 | B3 | 2/2008 |
| EP | 1354649 | A1 | 10/2003 |
| EP | 1809776 | B1 | 7/2007 |
| EP | 2145970 | A1 | 1/2010 |
| FR | 2864108 | A1 | 6/2005 |
| WO | 2006042930 | A1 | 4/2006 |
| WO | 2006042931 | A1 | 4/2006 |
| WO | 2006045383 | A1 | 5/2006 |

OTHER PUBLICATIONS

Llewellyn, D.T. Hudd, R.C. (1998). Steels-Metallurgy and Applications (3rd Edition)-4.3.3 Other Alloy Additions. Elsevier.*

Machine-English translation of Japanese publication No. 2003-253403, Hirasawa Junichiro et al., Sep. 10, 2003.*

The potential for vehicle body lightweight construction. ThyssenKrupp Automotive AG trade show journal for the 61st Frankfurt International Motor show, Sep. 15-25, 2005, 1 page.

* cited by examiner

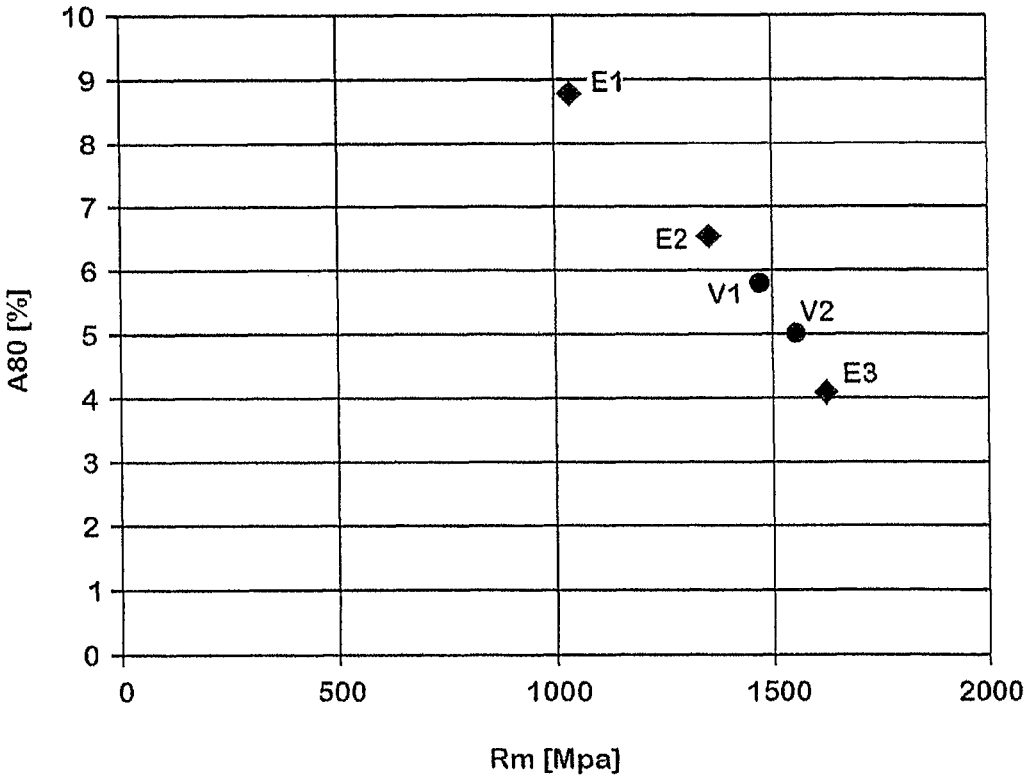
10
9
8
7
6
5
4
3
2
1
0
A80 [%]
E1
E2
V1
V2
E3
0
500
1000
1500
2000
Rm [Mpa]

METHOD FOR MANUFACTURING A HOT PRESS-HARDENED COMPONENT AND USE OF A STEEL PRODUCT FOR MANUFACTURING A HOT PRESS-HARDENED COMPONENT

BACKGROUND OF THE INVENTION

Field of the Invention

The invention relates to a method for manufacturing a hot press-hardened component, to a use of a steel product for manufacturing a hot press-hardened component and to a hot press-hardened component.

Description of the Related Art

To meet the current demand in modern vehicle body construction for less weight with at the same time maximum strength and protective effect, nowadays hot press-formed components made of high-strength steels are used in those areas of the vehicle body which in the event of a crash can be subjected to particularly heavy stresses.

In hot press-hardening, steel blanks which are separated from cold-rolled or hot-rolled steel strip are heated at a deformation temperature which is usually above the austenitisation temperature of the respective steel and are placed in the heated state into the die of a forming press. In the course of the forming subsequently carried out, the sheet blank or the component formed from it undergoes rapid cooling through contact with the cool die. The cooling rates are set in such a way that a martensitic structure develops in the component. Here, it can be sufficient for the component to be cooled by contact with the die alone without active cooling. However, rapid cooling can also be supported by the die itself being actively cooled.

As reported in the article "The potential for vehicle body lightweight construction" which appeared in the ThyssenKrupp Automotive AG trade show journal for the 61$^{st}$ Frankfurt International Motor Show, 15-25 Sep. 2005, hot press-hardening is in practice particularly used for manufacturing high-strength vehicle body components made of boron-alloyed steels. A typical example for such a steel is known under the designation "22MnB5" and can be found in the Key to Steel 2004 under the material number 1.5528.

The advantages of the known MnB steels are, however, in practice confronted with the disadvantage that steels with a high manganese content are too unstable against wet corrosion and can only be passivated with difficulty. This strong susceptibility to corrosion compared to more lowly alloyed steels with the action of increased chloride ion concentrations, which although it is limited locally is intensive, makes the use of steels belonging to the high-alloyed steel sheet material group difficult specifically in vehicle body construction. In addition, steels with a high manganese content are susceptible to surface corrosion, as a result of which the range for their use is also restricted.

Therefore, it has been proposed that steel flat products which are produced from steels with a high manganese content are also provided with a metallic coating, in a manner which is known per se, which protects the steel against corrosive attack. At the same time, however, the problem arose that such steel flat products can only be poorly wetted and consequently the adhesion to the steel substrate required from the coating during cold forming is not adequate.

A large number of proposals have been made for providing steel flat products produced from a steel with a high manganese content with a coating which protects against corrosion and which meets the requirements demanded in practice (DE 10 2005 008 410 B3, WO 2006/042931 A1, WO 2006/042930, DE 10 2006 039 307 B3 and many others). The common link between these proposals is that the steel flat product, which is to be coated in each case, has to be annealed in an annealing step, which is elaborate and difficult to control in terms of the technical process due to the conditions to be followed, so that it can subsequently be provided with the corrosion protection coating in an appropriate coating process. Furthermore, it has been shown that the coating of the steel flat products results in abrasion particularly on the rollers of the furnaces. As a result of this abrasive wear, a premature replacement or other maintenance measures are required, which are associated with long downtimes.

SUMMARY OF THE INVENTION

Against this background, the object of the invention consisted in specifying a method, by means of which high-strength components protected against corrosive attack can be manufactured more easily than with the previously mentioned known methods.

In addition, a use of a steel product should be specified which is particularly suitable for producing high-strength components in a simplified way which are not susceptible to corrosion.

Finally, a component, which is to be produced in a simplified way in terms of the technical method, should be specified which with a great ability to withstand stress is optimally protected against corrosion.

With regard to the method, this object is achieved according to the invention by performing the production steps specified in claim 1 when manufacturing a high-strength component from a steel flat product.

With regard to the use, the above mentioned object is achieved according to the invention by using a steel flat product according to claim 12 for manufacturing a component.

The above mentioned object with regard to the component is achieved according to the invention by the component being formed according to claim 14.

Advantageous embodiments of the invention are specified in the dependent claims and are explained in detail below in common with the general concept of the invention.

DESCRIPTION OF THE PREFERRED EMBODIMENTS

The invention is based on the realisation that a certain class of stainless steels known per se are suitable for hot press-hardening. In addition to optimum application and corrosion properties in practical use, the use according to the invention of such stainless steels for hot press-hardening has the advantage that there is no risk of corrosion either during the hot forming or during the hardening process despite the high temperatures produced in the course of this. Instead, the alloying constituents contained in the steel used according to the invention also protect the processed steel product from corrosive attack during these method steps. Hence, components which are high-strength and optimally protected against corrosion can be produced by hot press-hardening with the procedure and use according to the invention without protective measures being taken for this purpose which are always required with low-alloyed steels of the type used up to now for hot press-hardening. Thus, with the procedure according to the invention, it is neither necessary to provide the respectively processed steel product with a coating which protects against corrosion nor during heating must special measures be taken to protect the steel product from corrosion or to produce a certain surface character.

A first group of the steels which are suitable for press-hardening is the unstabilised ferrites, to which, for example, the steel standardised under the material number 1.4003 belongs. Ferritic steels can fully or partly transform martensitically during quenching of temperatures above the austenitisation temperature. These steels are particularly suitable for direct press-hardening but can also be formed in indirect processes.

In direct press-hardening, which is also called "single-step" press-hardening, a sheet blank fabricated from a suitable steel flat product is formed into the respective component in one go and subjected to the heat treatment required for setting the hardness desired in each case.

In indirect press form hardening, which is also called "two-step" press form hardening, the respective sheet blank is formed into the respective component in a first step. The component obtained is then heated to hardening temperature and then heat-treated in a further press forming die in the course of a subsequent press forming process in the manner required for setting the martensitic structure desired in each case.

A further group of the stainless steels suitable for press-hardening is martensites. Above 900 to 1000° C., these steels have an austenitic structure with a high carbon solubility. Martensite forms when they cool. Typical representatives of this steel type are the steels known under the material numbers 1.4021 and 1.4034.

Martensitic-ferritic steels, in which the structure in addition to martensite contains higher contents of ferrite, can also be press form hardened. The steel standardised under the material number 1.4006 belongs, for example, to this group.

Typical martensitic steels have carbon contents of 0.08-1% wt. They are hardened in the air. Their mechanical strength can, however, be further increased by quenching with higher cooling rates.

Martensitic steels with low carbon contents up to a maximum of 0.06% wt. are partly alloyed with up to 6% nickel. This composition causes austenite to partly form after quenching and tempering. Steels of this kind are called "nickel-martensitic" or "supermartensitic". Such steels are particularly suitable for direct press-hardening but can also be formed in indirect processes.

With precipitation hardening steels, such as for example the steel listed under the material number 1.4568, after solution annealing and quenching the precipitation of intermetallic compounds and of carbides, nitrides and copper phases from the martensitic structure results in increased strength. In this way, strengths of up to 1000 MPa can be obtained in direct press-hardening. After subsequent tempering treatment, the strength can be increased by up to 500 MPa. These steels are also suitable for indirect processes owing to their good cold formability. A further hardening potential also occurs by introducing uniform cold working (temper rolling) before forming.

As a result, the use according to the invention of a stainless steel product for manufacturing hot press-hardened components and the resultant method enable components to be manufactured in a considerably simplified manner compared to the prior art for hot press-hardening. These components, with respect to their mechanical properties and their protection against corrosion, are optimally suitable for demanding applications, such as for example vehicle body construction.

A component hot press-hardened according to the invention is produced from a steel product which consists of a stainless steel which contains (in % wt.) C: 0.010-1.200%, P: up to 0.1%, S: up to 0.1%, Si: 0.10-1.5%, Cr: 10.5-20.0% as required elements with iron and unavoidable impurities as the remainder.

The hardness of the martensite in the steel can be controlled by means of the amount of carbon contained in a steel used according to the invention which lies in the range from 0.01-1.2% wt. Optimum properties for the component produced by hot press-hardening according to the invention are then in this respect obtained if the steel used according to the invention contains 0.01-1.0% wt. C, in particular 0.01-0.5% wt.

Contents of 0.1-1.5% wt. Si act as an antioxidant and increase the strength of the steel.

The high Cr proportion of steels used according to the invention contributes considerably to resistance to corrosion, in particular in use at high temperatures. It brings about the formation of a Cr oxide layer on the surface at room temperature and also at high temperatures, so that the steel product processed according to the invention does not require additional corrosion protection either during the heat treatment or in later practical use. The Cr proportion in the material is more dimensionally stable at high temperatures, such as those present during the heating according to the invention to the respective austenitisation temperature TA, than with the corrosion-susceptible MnB grades conventionally used for the hot press-hardening. It is accordingly easier to process steel products used according to the invention at high temperatures. In particular, the steel product can also be conveyed from the heating device up to being placed in the respective pressing die without the risk of oxidation of the surface in the ambient air affecting the processing outcome. An optimally balanced relationship between alloying costs and positive effects of the Cr proportion of a steel used according to the invention then results if its Cr content lies between 11 and 19% wt., in particular 11-15% wt.

The contents of P and S are in case limited to 0.1% wt., in order to prevent negative effects of these elements on the mechanical properties of the steel processed according to the invention.

In addition to the previously mentioned required elements, the steel used according to the invention can optionally contain one or more elements from the group "Mn, Mo, Ni, Cu, N, Ti, Nb, B, V, Al, Ca, As, Sn, Sb, Pb, Bi, H" with the requirement that the elements concerned—if they are present—are each present in the following contents (specified in % wt.) Mn: 0.10-3.0%, Mo: 0.05-2.50%, Ni: 0.05-8.50%, Cu: 0.050-3.00%, N: 0.01-0.2%, Ti: up to 0.02%, Nb: up to 0.1%, B: up to 0.1%, V: up to 0.2%, Al: 0.001-1.50%, Ca: 0.0005-0.003%, As: 0.003-0.015%, Sn: 0.003-0.01%, Sb: 0.002-0.01%, Pb: up to 0.01%, Bi: up to 0.01% and H: up to 0.0025%.

The presence of Mn in contents of 0.10-3.0% wt. supports the desired austenite formation at high temperatures, so that the martensitic structure aimed for according to the invention is formed.

Molybdenum in contents of 0.05-2.50% wt. contributes to the improvement in the resistance to corrosion.

Nickel can be present in a stainless steel used according to the invention in contents of 0.05-8.50% wt., in particular 0.05-7.0% wt., in order to also increase the resistance to corrosion and support the austenite formation at high temperatures, as can be achieved with the procedure according to the invention during the heat treatment preceding the press forming. This effect already occurs with sufficient effectiveness with contents of up to 1.5% wt. nickel, so that the upper limit of the Ni content range can be restricted to this value in one practice-oriented embodiment of the invention.

Cu can also be added to a steel used according to the invention in contents of 0.050-3.00% wt. to support the austenite formation required for the development of the martensitic structure.

The hardness of the martensite in the steel used according to the invention can also be controlled via nitrogen contents of 0.01-0.2% wt., in particular 0.01-0.02% wt.

Ti in contents of up to 0.02% wt. minimises the risk of crack formation during casting of the stainless steel required in the course of manufacturing a steel product processed according to the invention.

Contents of up to 0.1% wt. of niobium also contribute to improving the formability of the steel during manufacture of the steel product used according to the invention.

B in contents of up to 0.1% wt., in particular 0.05% wt., also has a positive effect on preventing cracks when strip casting a steel processed according to the invention and reduces the risk of surface cracks during conventional continuous casting. In addition, the hardness of the martensite in the steel processed according to the invention can also be controlled by adding boron.

V in contents of up to 0.2% wt., in particular 0.1% wt., like Nb improves the formability during casting of the steel used according to the invention.

Al in contents of 0.001-1.50% wt., in particular 0.001-0.03% wt., and Ca in contents of 0.0005-0.003% wt. contribute to optimising the degree of purity of a steel used according to the invention when it is cast in strip casting or continuous casting.

As in contents of 0.003-0.015% wt., Sn in contents of 0.003-0.01% wt., Sb in contents of 0.002-0.01% wt., Pb in contents of up to 0.01% wt. and Bi in contents of up to 0.01% wt. are added to steel according to the invention, in order to prevent crack formation during strip casting or to prevent surface defects when hot rolling continuously cast steel used according to the invention.

The contents of H with a steel processed according to the invention are finally limited to up to 0.0025% wt., in order to prevent the development of so-called "delayed cracking", i.e. delayed, hydrogen-induced crack formation under the conditions prevailing in practical application.

The steel product used according to the invention and composed in the manner previously mentioned can be a steel flat product produced by hot or cold rolling, thus, for example, a blank obtained from a hot-rolled or cold-rolled, stainless steel sheet or strip. However, it is also possible to process a semi-finished product as the steel product, which has been preformed from a corresponding steel flat product before it is processed in the manner according to the invention.

Furthermore, the steel product used according to the invention can be formed as a so-called "tailored blank" from at least two steel flat product blanks which are joined to one another and differ from one another in terms of their thickness or physical properties. In this way, materials which are optimally matched to the stresses occurring in each case can be assigned to the sections of the component produced and provided according to the invention which in practice are stressed differently. Thus, it is also possible for just one part section of the steel flat product used according to the invention to consist of a stainless steel of the composition specified according to the invention, while another section is produced from a conventional low-alloyed and rust-sensitive steel, if this is indicated taking into account in each case the local conditions and stresses under which the component produced according to the invention is used in practice.

The correspondingly formed steel product according to the invention passes through the following production steps which are typical for hot press-hardening:

a) providing a steel product obtained in the previously explained manner;
b) heating the steel product through to an austenisation temperature above the Ac3 temperature of the stainless steel;
c) hot press-hardening the heated steel product into the component in a pressing die and
d) cooling at least one section of the component obtained at a cooling rate which is high enough for a martensitic structure to form in the section which is rapidly cooled in each case.

The formation of the martensitic structure in the component obtained according to the invention after hot press-hardening can be controlled by means of the height of the austenitisation temperature reached in each case. In order to obtain maximum strength values for a component produced according to the invention, the steel product processed according to the invention in the course of production step b) is heated to an austenitisation temperature which is above the Ac3 temperature of the stainless steel (Ac3 temperature: temperature at which the transformation into austenite is completed). The structure which in this case is fully austenitised fully transforms into martensite during subsequent cooling, so that a strong structure hardness and accompanying maximum tensile strength values are obtained.

The rapid cooling of the component hot press-hardened according to the invention, which is required to form the martensitic structure, can take place in a way which is known per se in the pressing die itself which is provided with a suitable cooling device for this purpose. Alternatively, the cooling can also take place after hot press forming in a separate production step if it is ensured that the component still has a sufficiently high temperature after the hot pressing process has ended.

In a way which is also known per se, both heating of the steel product before hot press forming and cooling after hot press forming can be limited to specific sections of the steel product if zones on the finished component are to be produced with different mechanical properties.

The steel flat product is preferably heated in a closed furnace. It is, however, also possible for heating to be performed by induction or conduction.

A component which can be highly stressed in all places can in contrast be produced according to the invention by the steel formed part being heated and cooled in such a way that a martensitic structure forms over its entire volume.

In order to reliably guarantee the formation of a martensitic structure (e.g. fully martensitic), with the procedure according to the invention cooling rates are sufficient which are at most 25 K/s, in particular at most 20 K/s, wherein particularly good production results occur if the cooling rate is restricted to at most 15 K/s. In order to guarantee that a sufficient hardness forms, the cooling rate should, however, be at least 0.1 K/s, in particular at least 0.2-1.3 K/s. Cooling rates above 25 K/s have shown that an unwanted rapid hardness increase occurs, which leads to restricted formability. Preferably, cooling rates are set between 5 and 20 K/s, wherein with an increasing cooling rate higher strengths can be achieved in the component.

The formation of the individual zones with different structures can also be affected by certain zones of the areas of the press forming die which come into contact with the steel product being heated, so that in those zones cooling of the steel product which leads to a martensitic structure is, for example, reliably prevented.

Components produced according to the invention consistently have a tensile strength amounting to at least 900 MPa in the areas in which they have a martensitic structure and have an elongation A80 in those areas of at least 2%.

Due to their practice-oriented combination of optimised mechanical properties, on the one hand, and high resistance to corrosion, on the other hand, components manufactured according to the invention by hot press-hardening a steel product produced from a stainless steel are particularly suitable as body parts for motor cars, commercial vehicles or rail vehicles, for aircraft or high-strength construction elements.

The invention is explained in more detail below with the aid of exemplary embodiments.

FIG. 1 shows a diagram, in which for different steels the elongation at break A80 in % is plotted above the tensile strength Rm in MPa.

The strength of the press-hardened components is converted into a tensile strength Rm by means of the hardness and the tables specified in DIN 50150. The values shown in DIN 50150 for Vickers hardness HV10 and the tensile strength are determined for unalloyed and low-alloyed steels.

Reference tests, which were carried out for the materials 4003 and 4034, produce a good match between the table values and the HV10 and tensile strength values measured on hardened tensile test samples. The results of the reference tests are given in Table 1.

TABLE 1

| Steel | HV10 (measured) | Tensile strength (measured) [MPa] | Tensile strength (conversion) [MPa] |
|---|---|---|---|
| 4003 | 320 | 1030 | 1075 |
| 4034 | 499 | 1629 | 1630 |

Different tests were carried out using blanks manufactured from steels S1-S9. The material numbers ("Type") and the alloying elements of the steels S1-S9 in question which determine the properties are recorded in Table 2.

TABLE 2

| | Type | C | P | S | Si | Cr | Other |
|---|---|---|---|---|---|---|---|
| S1 | 1.4003 | 0.011 | 0.025 | 0.0015 | 0.32 | 11.0 | Mn: 1.03 |
| S2 | 1.4006 | 0.110 | 0.022 | 0.0027 | 0.89 | 13.61 | |
| S3 | 1.4021 | 0.265 | 0.030 | 0.0021 | 0.27 | 13.17 | |
| S4 | 1.4028 | 0.352 | 0.021 | 0.0024 | 0.37 | 13.17 | |
| S5 | 1.4034 | 0.469 | 0.023 | 0.0021 | 0.41 | 15.31 | |
| S6 | 1.4112 | 0.930 | 0.023 | 0.0019 | 0.78 | 18.81 | Mo: 1.3<br>V: 0.12 |
| S7 | 1.4418 | 0.031 | 0.027 | 0.0023 | 0.98 | 16.29 | Mo: 1.5<br>Ni: 6.0<br>N: 0.03 |
| S8 | 1.4568 | 0.070 | 0.021 | 0.0025 | 0.25 | 18.0 | Ni: 7.75<br>Al: 1.5 |
| S9 | 1.4532 | 0.080 | 0.023 | 0.0025 | 0.41 | 15.7 | Ni: 7.75<br>Mo: 2.49<br>Al: 1.5 |

In Table 3, the tensile strength and Vickers hardness HV10, which in each case are determined before press-hardening, as well as the respective Ac1 temperature, in which the transformation into austenite begins, and the Ac3 temperature, in which the transformation into austenite and the end of the ferrite dissolution is completed, are additionally recorded for blanks produced from the steels S1-S7.

In order to achieve high degrees of deformation, on the one hand, and optimum strengths, on the other, in the present case heating is carried out above the Ac3 temperature and is dependent on the C and Cr content of the stainless steel in order to ensure that the ferrites and carbides where applicable fully dissolve. Carbides can have a disruptive influence at high degrees of deformation and can, for example, lead to cracks in the component.

Above Ac3, a homogenous austenite can be present as well as an austenitic-carbidic structure with increased C content.

TABLE 3

| | Rm | A80 | HV10 | Ac1 | Ac3 |
|---|---|---|---|---|---|
| S1 | 498 | 26.9 | 154 | 795 | 885 |
| S2 | 532 | 25.4 | 162 | 795 | 885 |
| S3 | 591 | 25.1 | 191 | 795 | 885 |
| S4 | 513 | 24.7 | 198 | 835 | 880 |
| S5 | 655 | 22.9 | 209 | 790 | 845 |
| S6 | 763 | 16.5 | 258 | 810 | 855 |
| S7 | 1110 | 8.2 | 370 | 600 | 720 |

Steel sheet formed parts were formed from the blanks produced from the steels S1-S7 by direct press form hardening which takes place in one go. Vickers hardness HV10 was then measured for the steel sheet formed parts obtained in this way and the tensile strength was determined from this in the way described in DIN 50150.

For the purpose of verifying the component properties obtained, tensile samples from the steels S1, S4 and S5 were directly press-hardened. The tensile strength Rm and the elongation A80 were then determined on the hardened samples S1', S4' and S5' according to DIN 10002.

The properties from the steels S1-S7, measured and determined in the way previously mentioned, are recorded in Table 4.

TABLE 4

| | HV10 measured | Rm [MPa] determined according to DIN 50150 | Rm [MPa] measured according to DIN 10002 | A80 |
|---|---|---|---|---|
| S1, S1' | 335 | 1075 | 1030 | 8.8 |
| S2 | 417 | 1120 | | |
| S3 | 470 | 1520 | | |
| S4, S4' | 397 | 1278 | 1350 | 6.5 |
| S5, S5' | 500 | 1630 | 1621 | 4.1 |
| S6 | 561 | 1848 | | |
| S7 | 360 | 1155 | | |

Cooling tests were carried out in order to determine the effect of the cooling rate on the component hardness obtained with the procedure according to the invention. Here, in a two-step process, blanks which consisted of one of the steels S3-S8, were firstly hot press formed, cooled over different cooling periods t8/5 from 800° C. down to 500° C. and then down to room temperature. Since the most important transformations take place in the range between 800° C. and 500° C., maintaining the cooling rate according to the invention in this range is of particular importance, so that influence can be exerted on the strength values in a targeted way. Vickers hardness HV10 was then measured for each of the components obtained in this way. The results of these tests and the cooling rates obtained in the course of cooling are recorded in Table 5.

TABLE 5

| t8/5 [s] | K [K/s] | Steel S3 HV10 | Steel S4 HV10 | Steel S5 HV10 | Steel S6 HV10 | Steel S7 HV10 | Steel S8 HV10 |
|---|---|---|---|---|---|---|---|
| 40 | 7.50 | 419 | 501 | 587 | 672 | 679 | 375 |
| 150 | 2.00 | | 499 | | | | |
| 200 | 1.50 | | | | 654 | 649 | |
| 230 | 1.30 | 415 | | | | | |
| 600 | 0.50 | | | | 575 | | 485 |
| 650 | 0.46 | | 467 | | | | |
| 700 | 0.43 | 387 | | 523 | | | |
| 3500 | 0.09 | | | 250 | | | |
| 5000 | 0.06 | | 421 | | | | |

According to this, in order to form the martensitic structure, in each case cooling rates which are clearly below the cooling rates usually applied during press form hardening are sufficient. With slow cooling, the steels processed according to the invention still transform martensitically. This has a beneficial effect on the manufacturing process, since particularly with one-step direct press form hardening the forming die does not have to be cooled as intensely.

Components produced by direct press form hardening in practice often pass through another heat treatment step. This is particularly the case if the press formed parts are components for motor vehicle bodies which in the course of further processing are stove-enameled. The effect of such a tempering treatment or a comparable treatment on the strength and elongation values of the components press form hardened according to the invention was examined based on components, in each case consisting of one of the steels S2, S3 and S7 produced according to the invention by direct press form hardening, which were tempered under the conditions specified in Table 6, and in which in the course of the tempering treatment the properties also specified in Table 6 have materialised.

TABLE 6

| Steel | Tempering temperature [° C.] | HV10 | Rm, determined according to DIN 50150 [MPa] |
|---|---|---|---|
| S2 | 170 | 351 | 1130 |
| | 250 | 350 | 1126 |
| | 500 | 346 | 1110 |
| S3 | 170 | 467 | 1510 |
| | 250 | 467 | 1510 |
| | 500 | 454 | 1470 |
| S7 | 170 | 356 | 1145 |
| | 250 | 341 | 1145 |
| | 500 | 311 | 998 |

It has been shown that tempering in the temperature range from 170-500° C. covered by the tests in each case at the most results, in a very slight decrease in the strengths of the components produced according to the invention.

In order to test the process of indirect press-hardening, a blank consisting of the steel S9 was processed. After solution annealing, the blank had a tensile strength Rm of 816 MPa. The blank obtained in this way was then formed into a component to simulate the press forming process and held at 820° C. for a period of 30 minutes, so that it could be subsequently quenched in the die at a cooling rate of approx. 15 K/s dependent on the component area and contact time. After quenching, the component had a hardness HV10 of 340 which corresponds to a tensile strength Rm of approx. 1015 MPa.

For comparison, a steel sheet consisting of the same S9 material was temper-rolled to a thickness of 1 mm. As a result of the hardening, which occurred in the course of the temper rolling, the temper-rolled sheet had a tensile strength of 1500 MPa. The temper-rolled steel sheet, which in this state can only be formed in a limited manner, was then bent by 90° with a bending radius of 9 mm. The angle profile obtained in this way was tempered in the furnace at 550° for one hour and then cooled in the die. The cooling rate thereby achieved was 10 K/s. The bent and hardened profile obtains a hardness HV10 of 571. In the diagram attached as FIG. 1, for components E1, E2, E3, produced according to the invention from blanks which consisted of the steels S1, S4 and S5, the elongation A80 is in each case recorded above the tensile strength Rm. For comparison, for two components which were produced by conventional hot press form hardening from the steel MBW 1500 usually used for this purpose containing C≤0.2%, Si≤0.4%, Mn≤1.4%, P≤0.025%, S≤0.01%, Cr+Mo≤0.5%, Ti≤0.05% and B≤0.005% (specified in % wt.), the elongation values A80 are specified above the respective tensile strength value Rm.

It has been shown that the components E1, E2 produced from the ferritic steel S1 and the martensitic steel S4 have a combination of elongation value and tensile strength superior to the conventionally produced components, while the third component produced according to the invention has a better tensile strength with elongation values which are still good. In addition, components produced according to the invention are more resistant to corrosion and do not require any additional corrosion protection coatings.

The invention claimed is:

1. A method for manufacturing a hot press-hardened vehicle body component, comprising the following production steps:

a) heating a steel product produced at least in sections from a stainless steel comprising the following composition (specified in % wt.)

C: 0.031-1.200%,
P: up to 0.1%,
S: up to 0.1%,
Si: 0.10-1.5%,
Cr: 10.5-20.0%,
optionally, at least one element that promotes the formation of austenite selected from the group consisting of Mn: 0.10-3.0%, Ni: 0.05-8.50%, and Cu: 0.050-3.00%,
and optionally one or more elements from the group "Mo, N, Ti, Nb, B, V, Al, Ca, As, Sn, Sb, Pb, Bi, H" with the requirement
Mo: 0.05-2.50%,
N: 0.01-0.2%,
Ti: up to 0.02%,
Nb: up to 0.1%,
B: up to 0.1%,
V: up to 0.2%,
Al: 0.001-1.50%,
Ca: 0.0005-0.003%,
As: 0.003-0.015%,
Sn: 0.003-0.01%,
Sb: 0.002-0.01%,
Pb: up to 0.01%,
Bi: up to 0.01%,
H: up to 0.0025%,
remainder iron and unavoidable impurities to an austenisation temperature above the Ac3 temperature of the stainless steel, wherein the microstructure of the stainless steel is converted to a fully austenitic microstructure;

b) hot press-hardening the heated steel product in a pressing die to form the vehicle body component; and c) cooling at least one section of the vehicle body component at a cooling rate that is high enough for a fully martensitic structure to form in each section that is rapidly cooled.

2. The method according to claim 1, wherein the vehicle body component is cooled in the pressing die in such a way that the martensitic structure forms.

3. The method according to claim 1, wherein the areas of the pressing die coming into contact with the steel product are heated in sections.

4. The method according to claim 1, wherein the vehicle body component is cooled in such a way that a martensitic structure forms throughout its entire volume.

5. The method according to claim 1, wherein the cooling rate, at which the vehicle body component at least in sections is cooled, is at most 25 K/s.

6. The method according to claim 5, wherein the cooling rate, at which the vehicle body component at least in sections is cooled, is at least 0.1 K/s.

7. The method according to claim 1, wherein the steel product is a steel flat product.

8. The method according to claim 1, wherein the steel product is a preformed semi-finished product.

9. The method according to claim 1, wherein the steel product is formed from at least two steel flat product blanks that are joined to one another and differ from one another in terms of their thickness or physical properties.

10. The method according to claim 1, wherein the C content of the stainless steel is 0.5% wt. or less.

11. The method according to claim 1, wherein the Cr content of the stainless steel is 11-19% wt.

12. A method of using a steel product consisting at least in sections of a stainless steel that comprises (in % wt.)

C: 0.031-1.200%,
P: up to 0.1%,
S: up to 0.1%,
Si: 0.10-1.5%,
Cr: 10.5-20.0%,
optionally, at least one element that promotes the formation of austenite selected from the group consisting of Mn: 0.10-3.0%, Ni: 0.05-8.50%, and Cu: 0.050-3.00%,
and optionally one or more elements from the group "Mo, N, Ti, Nb, B, V, Al, Ca, As, Sn, Sb, Pb, Bi, H" with the requirement
Mo: 0.05-2.50%,
N: 0.01-0.2%,
Ti: up to 0.02%,
Nb: up to 0.1%,
B: up to 0.1%,
V: up to 0.2%,
Al: 0.001-1.50%,
Ca: 0.0005-0.003%,
As: 0.003-0.015%,
Sn: 0.003-0.01%,
Sb: 0.002-0.01%,
Pb: up to 0.01%,
Bi: up to 0.01%,
H: up to 0.0025%,
remainder iron and unavoidable impurities,
the method comprising the step of using the steel product to manufacture a hot press-hardened vehicle body component, wherein the vehicle body component comprises areas having a fully martensitic structure, a tensile strength amounting to at least 900 MPa, and an elongation A80 of at least 2%.

* * * * *